US010214891B2

(12) United States Patent
Kimberlain

(10) Patent No.: US 10,214,891 B2
(45) Date of Patent: Feb. 26, 2019

(54) MODULAR STORMWATER CAPTURE SYSTEM

(71) Applicant: Michael Kimberlain, Escondido, CA (US)

(72) Inventor: Michael Kimberlain, Escondido, CA (US)

( * ) Notice: Subject to any disclaimer, the term of this patent is extended or adjusted under 35 U.S.C. 154(b) by 131 days.

(21) Appl. No.: 14/709,839

(22) Filed: May 12, 2015

(65) Prior Publication Data

US 2016/0333562 A1 Nov. 17, 2016

(51) Int. Cl.
*E03F 1/00* (2006.01)

(52) U.S. Cl.
CPC ..... *E03F 1/002* (2013.01)

(58) Field of Classification Search
CPC ... E03F 1/00; E03F 1/001; E03F 1/002; E03F 1/003; E03F 1/004; E03F 1/005; E03F 1/006; E03F 1/007; E03F 1/008
USPC ..... 210/170.01, 170.03, 170.07, 170.08; 405/36, 43, 50, 52, 53, 55
See application file for complete search history.

(56) References Cited

U.S. PATENT DOCUMENTS 2,708,846 A * 5/1955 Cherry ..... E04B 1/20 52/232
2,897,668 A * 8/1959 Graham ..... E04H 9/10 109/1 S
3,339,366 A 9/1967 Gogan et al.
3,678,637 A * 7/1972 Klipfel ..... E04B 1/34815 52/79.3
3,720,022 A 3/1973 Dattner
3,878,656 A * 4/1975 Duwe ..... E04H 13/006 52/134
3,910,051 A 10/1975 Komisarek
4,462,390 A * 7/1984 Holdridge ..... A01G 9/243 126/587
4,586,299 A * 5/1986 Bayer ..... E04B 1/348 52/79.7
4,917,536 A * 4/1990 Glasser ..... E02B 11/00 405/36

(Continued)

FOREIGN PATENT DOCUMENTS

EP 1818463 A1 8/2007

*Primary Examiner* — Benjamin F Fiorello
*Assistant Examiner* — Edwin J Toledo-Duran
(74) *Attorney, Agent, or Firm* — Charles F. Reidelbach, Jr.

(57) ABSTRACT

A modular fluid capture system retains stormwater runoff beneath a ground surface. Internal components include columns and struts, while outer components include walls, ceilings, and/or floors. Load bearing vertical column components having column openings are spaced apart and/or stacked to form capture system layer(s). Elongated horizontal strut components install into the column openings to couple columns into an interconnected internal structure that distributes physical loads across all or most column components. Wall, ceiling, and/or floor components couple to this interconnected internal structure to form the outer walls, ceiling, and floor. The overall fluid retention volume is the overall volume within the walls, ceiling, and floor, minus the displacement volume of the internal components. This overall system fluid retention volume is substantially greater than the displacement volume. The number of internal components can be readily increased or decreased to increase or decrease correspondingly the system size and overall fluid retention volume.

17 Claims, 12 Drawing Sheets

(56) References Cited

U.S. PATENT DOCUMENTS

| | | | | |
|---|---|---|---|---|
| 4,942,708 | A | 7/1990 | Krumholz et al. | |
| 5,103,604 | A * | 4/1992 | Teron | E04B 1/34861 52/126.3 |
| 5,426,900 | A * | 6/1995 | Springer | A47K 4/00 4/460 |
| 5,624,204 | A | 4/1997 | Dorsemaine | |
| 5,810,510 | A | 9/1998 | Urriola | |
| 6,221,445 | B1 | 4/2001 | Jones | |
| 6,766,623 | B1 * | 7/2004 | Kalnay | E04B 1/34305 135/128 |
| 6,962,463 | B2 | 11/2005 | Chen | |
| 6,991,402 | B2 * | 1/2006 | Burkhart | E03F 1/005 405/126 |
| 7,160,058 | B2 | 1/2007 | Burkhart | |
| 7,603,959 | B1 * | 10/2009 | Veazey | B63B 3/08 114/263 |
| 8,113,740 | B2 * | 2/2012 | Boulton | E03B 11/14 405/36 |
| 8,770,890 | B2 * | 7/2014 | May | E03F 1/002 405/126 |
| 8,926,218 | B1 * | 1/2015 | Savage | E03F 1/00 405/53 |
| 2008/0134589 | A1 * | 6/2008 | Abrams | E04B 1/003 52/79.1 |
| 2011/0123275 | A1 * | 5/2011 | Nelson | B63B 35/44 405/211 |
| 2013/0168041 | A1 * | 7/2013 | Teron | E04B 5/48 165/49 |
| 2013/0305629 | A1 * | 11/2013 | Stephenson | E04B 1/3483 52/79.9 |
| 2014/0078652 | A1 * | 3/2014 | Kamen | H05K 7/00 361/679.01 |
| 2015/0151914 | A1 * | 6/2015 | Boulton | B65G 5/005 210/170.03 |

* cited by examiner

MODULAR STORMWATER CAPTURE SYSTEM

TECHNICAL FIELD

The present disclosure relates generally to fluid management, and more particularly to the capture and/or detention of fluids such as underground stormwater runoff at building or other development sites.

BACKGROUND

The Federal Water Pollution Control Act of 1948 included some of the first major laws to address water pollution in the United States. This act was amended in 1972 to address growing concerns and continued degradation of U.S. waters, and the amended act commonly became known as the Clean Water Act. While initially only addressing point sources, later research and other factors prompted congress to address stormwater pollution via the Water Quality Act of 1987. Through this act, point and non-point source pollutants are regulated through the National Pollutant Discharge Elimination System permit program. One requirement of this program is for municipalities, developers, and other industrial dischargers to implement various minimum control measures or Best Management Practices ("BMPs"). One of these minimum control measures involves providing post-construction or structural BMPs. Structural BMPs are designed to manage the quantity of and to improve the quality of stormwater runoff. Such structural BMPs can generally be divided into two categories: Quality Control BMPs and Quantity Control BMPs. One or both of these types of Structural BMPs can be implicated when it comes to constructing and managing buildings, parking lots, roads, and various other developments and land improvements.

Developing land or improving existing developments thereupon can create extra burdens with respect to stormwater runoff in the area. Impermeable surfaces such as roofs, roads, parking lots, and the like can increase the volume and velocity of stormwater runoff, particularly in comparison with ordinary undeveloped land having soil and other natural components that can adsorb and contain the stormwater therein. This increase in the volume and velocity of the runoff can erode stream beds and channels, and also inundate municipal stormwater infrastructure. Early BMPs for controlling the volume and velocity of stormwater runoff consisted of above ground retention ponds that detained stormwater routed there via storm drain conveyance systems. As ponds fell out of favor due to safety and vector concerns, and as land costs escalated, retention systems began to be constructed underground instead.

It is generally well accepted that underground stormwater detention systems are preferable in many urban and well developed areas. The use of such systems allows for other uses of the actual surface regions, and also reduces safety hazards such as water dangers, mosquito breeding opportunities, and the like. Initial underground water detention systems were designed from pipe or large concrete structures, such as box culverts. Subsequent iterations of stormwater retention systems consisted of arched chambers made of plastic or concrete. Some of these systems consist of modular plastic crates or boxes, while others consist of large modular concrete boxes. Various further details regarding such modern underground stormwater retention systems can be found at, for example, U.S. Pat. No. 7,344,335 and European Patent No. EP 1818463 A1, both of which are incorporated by reference herein for such purposes.

Unfortunately, such underground water detention systems do have drawbacks and restrictions for those that implement them. For example, the more common concrete types of systems tend to involve the use of huge and bulky modular pieces that are often installed by way of a crane or other heavy construction equipment. The alternative plastic types of systems tend to be weaker and more prone to failure or other problems, such that these systems are not seen as big improvements over the huge concrete counterparts. With many types of both of the current concrete and plastic systems, such as that which is found in the foregoing examples, any modular nature involves the repetitive use of the same or similar self-sufficient and independent "building block" types of component. Accordingly, there tends to be little overall structural integrity or load sharing across an entire system of independent modular blocks stacked with each other. Furthermore, internal volumes that could be used to contain more fluid are instead used for redundant and unneeded ceilings, floors, and walls of the independent modular blocks that form the overall structure.

While various systems and techniques for capturing and retaining stormwater runoff have generally been adequate in the past, there is always a desire for improvement. To that end, it would be desirable to have improved underground stormwater capture and retention systems, and in particular for such systems to maintain overall strength while having greater fluid retention capacities per unit volumes, having better overall structural integrity, and being buildable without the use of heavy machinery.

SUMMARY

It is an advantage of the present disclosure to provide improved systems, methods, and techniques for capturing and retaining fluids, such as underground stormwater runoff at building or other development sites. In particular, the improved systems and methods can maintain overall strength and modularity advantages while also providing greater fluid retention capacities per unit volumes and improved overall structural integrities. This can be accomplished at least in part by providing repetitive basic internal components that are assembled in a modular manner into an interconnected internal structure that distributes physical loads across the entire structure while taking up a minimal amount of internal space, as well as repetitive basic outer components that form the walls, ceiling, and/or floor around the interconnected internal structure. In particular, the internal components can include interconnected load bearing vertical columns that are coupled by way of horizontal struts, with the overall size and shape of the system being customizable and adjustable by adding or removing columns where and as desired.

In various embodiments of the present disclosure, a modular fluid capture system adapted to retain stormwater runoff beneath a ground surface can include at least various separate pluralities of column components, strut components, wall components, ceiling components, and optional floor components. The plurality of load bearing vertical column components can be located at a plurality of vertical column locations, and can define one or more capture system layers. Some or all of the plurality of vertical column components can include one or more column openings therein. The plurality of elongated horizontal strut or rail components can each have one or more distal ends and can each be installed into one or more of column openings, such that at least a portion of the plurality of horizontal strut components are each installed into and are adapted to transfer physical loads between multiple vertical column components. The plurality of wall components can be adapted to couple to one or more distal ends of the horizontal strut components, one or more column components, or both. The plurality of ceiling components can be adapted to couple to one or more vertical column components, one or more horizontal strut components, or both. The wall components and ceiling components can collectively define the outer walls and ceiling of the modular fluid capture system. Furthermore, the overall fluid retention volume of the capture system can be substantially defined by the overall volume contained within the wall components, the ceiling components, and the bottom of the lowest capture system layer, minus the displacement volume of the internal components, such as the plurality of vertical column components and the plurality of horizontal strut components.

In various detailed embodiments, at least a portion of the vertical column components can be adapted to stack atop others of the vertical column components for each capture system layer at a given vertical column location. Also, the fluid retention volume of the modular fluid capture system is substantially greater than the displacement volume of the plurality of vertical column components and the plurality of horizontal strut components. In some embodiments, a majority or all of the various components can be formed from concrete. In addition, a majority or all of the various components can weigh between about 50 to 200 pounds. For example, some or all of the vertical column components can be made of concrete and can weigh this amount.

In various further detailed embodiments, which can include some or all of the foregoing features, one or more of the plurality of vertical column components can each includes a capital portion, a shaft portion, and a plinth portion. Also, a plurality of the capital portions can each include one or more of the column openings therein and a plurality of the plinth portions can each include one or more of the column openings therein. The column openings can comprise slots, grooves, or both in the vertical column components. In various embodiments, the modular fluid capture system can also include a plurality of floor components adapted to rest beneath a bottom capture system layer of vertical column components. Such a plurality of optional floor components can collectively define the outer floor of said modular fluid capture system. Alternatively, or in combination, the ground or soil can form all or part of the outer floor of the system. In addition, the number of vertical column components can be readily increased or decreased in order to increase or decrease correspondingly the overall size and the fluid retention volume of said modular fluid capture system.

In various further embodiments of the present disclosure, a fluid capture system adapted to retain stormwater runoff beneath a ground surface can comprise a plurality of outer components and a plurality of internal components. The outer components can be adapted to be assembled together to define collectively at least the outer walls and ceiling of the system. The internal components can be adapted to be assembled together in an interconnected manner to provide support collectively for said outer components and external loads incumbent thereupon. Further, the internal components can interact while assembled in an interconnected manner to distribute the external loads across a majority or all of said plurality of internal components. The plurality of internal components can include a plurality of load bearing vertical column components that are distributed across an internal volume of the fluid capture system and that are all spaced apart from each other in all lateral directions. Further, the number of internal components can be readily increased or decreased in order to increase or decrease correspondingly the overall size and the overall fluid retention volume of the overall modular fluid capture system.

In various detailed embodiments of any of the foregoing, the plurality of internal components can include a plurality of load bearing vertical column components and a plurality of elongated horizontal strut components. Again, each of the plurality of vertical column components can include one or more column openings therein, and at least a portion of the plurality of horizontal strut components can each be installed into and be adapted to transfer physical loads between multiple vertical column components. In various embodiments, a first portion of the plurality of vertical column components can each laterally spaced apart from each other in a grid-like pattern to form a first capture system layer. In addition, a second portion of the plurality of vertical column components can each stacked atop one of the vertical column components in the first portion to form a second capture system layer atop the first capture system layer. In various embodiments, substantially all of said plurality of outer components and substantially all of said plurality of internal components can each have an individual weight of less than about 200 pounds. Again, the number of internal components, as well as the number of outer components, can be readily increased or decreased in order to increase or decrease correspondingly the overall size and the fluid retention volume of the modular fluid capture system.

In still further embodiments of the present disclosure, various methods of retaining stormwater runoff beneath a ground surface are provided. Pertinent process steps can include permitting a determination of a desired overall fluid retention volume for a modular fluid capture system that retains stormwater runoff beneath a ground surface, allowing at least one calculation regarding one or more amounts of internal components needed based upon the desired overall fluid retention volume, providing a plurality of internal components and a plurality of outer components, facilitating the assembly of the internal components together and the assembly of the outer components thereto, and facilitating the inclusion of one or more fluid inlets. The plurality of internal components can include at least the one or more amounts of internal components needed, and the plurality of internal components can be adapted to be assembled together to provide support collectively for external loads incumbent upon the system. The assembly of the internal components can form an interconnected internal structure, wherein external loads incumbent thereupon are distributed across a majority or all of the interconnected internal structure. The outer components can be adapted to be assembled to one or more external regions of the interconnected internal structure, and assembly of the outer components can define collectively at least the outer walls and ceiling of the modular fluid capture system. The overall fluid retention volume of the system can be substantially defined by the overall volume contained within the plurality of outer components minus the displacement volume of the interconnected internal structure, and this overall fluid retention volume can be significantly greater than the displacement volume of the interconnected internal structure. Also, the one or more fluid inlets can allow stormwater runoff to enter the assembled modular fluid capture system.

In various detailed embodiments, the plurality of internal components can include a plurality of load bearing vertical column components, wherein said assembly of the plurality of internal components includes laterally spacing a first portion of the vertical column components apart from each other in a grid-like pattern to form a first capture system layer. Added process steps can include allowing a redetermination of a new desired overall fluid retention volume for the modular fluid capture system, wherein the redetermined new desired overall fluid retention volume is larger or smaller than the original desired fluid retention volume, as well as facilitating a recalculation regarding the amount(s) of internal components needed based upon the new desired overall fluid retention volume, wherein the recalculated amount(s) of internal components needed are correspondingly larger or smaller than the original one or more amounts.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed systems, components, and methods with respect to modular stormwater capture systems. These drawings in no way limit any changes in form and detail that may be made to the disclosure by one skilled in the art without departing from the spirit and scope of the disclosure.

DETAILED DESCRIPTION

Figure 1A:
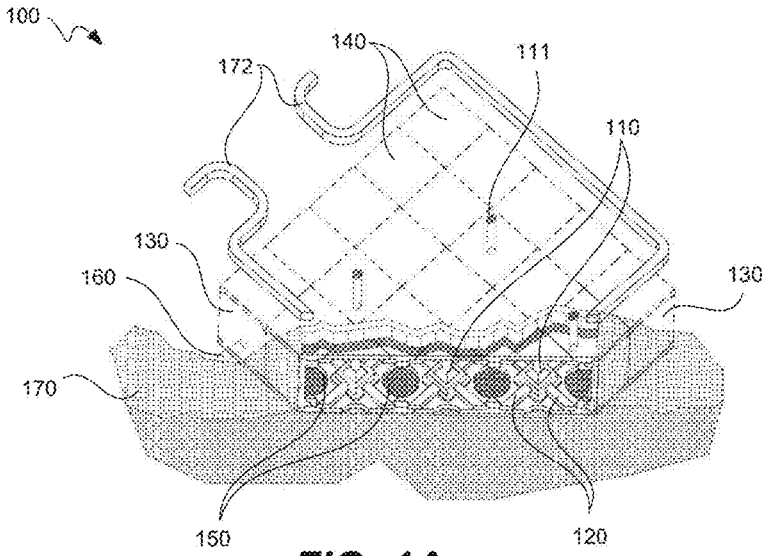
FIG. 1A illustrates in top perspective and partially cutaway view an exemplary modular stormwater capture system installed into an underground region of a development according to one embodiment of the present disclosure.

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

In various embodiments of the present disclosure, fluid management systems are provided. In particular, modular stormwater capture systems and components therefor are provided to facilitate the capture and retention of stormwater runoff and/or other fluids as desired for various land improvements and developments, such as at an underground location. This is particularly useful where impermeable surfaces are implemented in a given development, although other reasons may certainly apply. In other embodiments, various methods are provided for capturing, retaining, and/or otherwise managing stormwater runoff and/or other fluids, such as at a location below ground level. Although the various examples, illustrations, and detailed discussions herein are usually specific with respect to stormwater runoff and underground locations, it will be readily appreciated that the various systems and methods provided herein may also be used with respect to fluids other than stormwater or even water, and/or at locations other than underground. Use of the provided systems and methods may be done with or without ordinary or customary modifications, as may be preferred for whatever fluids, locations, and/or other specific restrictions that might apply for a given alternative application.

In general, the present disclosure provides an improved modular fluid capture and/or retention system that utilizes various basic structural components or elements. These basic or core components can be assembled in a myriad of different ways to form a singular unified structure or system. The overall size, shape, and other features of the overall system can be customized and/or modified as may be desired, due to the modular nature of the basic or core components. The basic structural components or elements can include various types of inner or internal components, as well as various types of external or outer components. Internal components can include, for example, columns, supports, spacers, struts, rails, connectors, and the like, among other possible items. Outer components can include, for example, walls, ceilings, floors, tiles, slabs, connectors, and the like, among other possible items.

Some or all of these various basic components can be made from pre-cast concrete in many embodiments, but can alternatively be made from other structural materials as may be desired. In some systems, a mix of basic components made from concrete and/or other suitable materials may be implemented. For example, steel or metal horizontal struts or rails may be used with concrete columns. In some embodiments, some or all of the various basic components can weigh about 200 pounds or less, such that these basic components can be manually installed or arranged without the need for cranes or heavy equipment. Accordingly, an entire modular stormwater capture system can typically be assembled manually by one or more workers without any need for heavy machinery or special equipment.

Some or all of the internal components can be assembled to form an interconnected internal structure in a manner such that physical loads bearing thereupon are better distributed across the entire or most of the interconnected internal structure. Outer components, such as walls, ceilings, and/or floors, can be assembled to the interconnected internal structure when that structure is complete, or can in some cases be placed onto portions or locations of the interconnected internal structure while that structure is being formed simultaneously. In general, floor pieces or components can couple or connect with column components and wall pieces or components. Columns or column components can couple to other columns and wall pieces, tiles, or components by way of horizontal struts, rails, or other similar components. Column components and wall components can connect with roof slabs, ceiling components, tiles, or similar items. The struts, rails, and/or the like can assist in coupling the various pieces and components, distributing loads, and locking the components together structurally.

When fully assembled together, all of the various pieces and components can form a sub-surface fluid storage system that acts homogeneously with respect to applied loads and water storage. Accordingly, physical loads are shared or distributed in improved fashion across the full system, and redundancies in inner walls, floors, and ceilings are reduced or eliminated, such that overall fluid volume is increased. In various embodiments, fluid, such as stormwater runoff, can enter through one or more pipes and/or other fluid inlets located on the sides and/or top of the overall system. This water and/or other fluid can also exit through a restricted orifice outlet, and/or through infiltration into the native soil, as may be desired for a particular application.

Another drawback of various prior art systems that utilize large concrete modules is that a mastic or other water resistant seal is typically installed across the exterior to cover gaps that form between the large independent modules. Such a mastic or other covering can act as a seal for the stormwater runoff or other fluid retained therein, and can also act to prevent or hinder soil or backfill from also entering the gaps between the modules. Because the various improved modular systems provided herein do not utilize such large repetitive modules, and thus tends to have little or no gaps between outer surface components, such a mastic or other seal is not always necessary. In fact, the smaller modular outer components of the present systems can be seamed together in an improved fashion such that gaps are minimized or eliminated. In addition, the present systems can also utilize underlying secondary components that bridge any potential small gaps, such that the underlying components can advantageously act as both a water seal and structural seal for the overall system.

Referring first to FIG. 1A, an exemplary modular stormwater capture system installed into an underground region of a development is illustrated in top perspective and partially cut-away view. Modular fluid capture system 100 can be at an underground location 170 that is beneath one or more above ground improvements, 172, such as roads, sidewalks, curbs, parking lots, buildings, and the like. System 100 can be formed in a grid or other pattern, such as a 5×5 grid, as shown, although it will be readily appreciated that this or other similar systems can be smaller or much larger in nature, and can take on a variety of shapes, such as, for example, a 30×15 grid. Also, although system 100 only has a single capture system "level" as shown, this or other similar systems can have heights of two, three, or many more levels, as may be desired.

Modular fluid capture system 100 can be formed in a modular fashion from a variety of components, such as, for example, various columns 110, struts or rails 120, wall tiles or pieces 130, ceiling tiles or pieces 140, and/or floor tiles or pieces 150. In addition, one or more fluid inlets 160 and optional outlets may also be present. A plurality of load bearing vertical column components 110 can be located at a plurality of vertical column locations across the system 100. For example, for a 5×5 grid system, there can be 16 full load bearing vertical column components 110 at the various corner intersections between grid sections. Various half or partial vertical column components can be located at the wall tiles or pieces, as set forth in greater detail below. Each of load bearing vertical column components 110 can be spaced apart in all lateral directions from the other vertical column components. The distance between any given pair of nearby vertical column components can be on the order of about two feet, although other smaller or larger distances may also be used as desired. In this manner, no vertical load bearing components are side by side or directly adjacent to each other, such that internal volume is maximized.

While these 16 full column components 110 (and further possible half or partial column components) can define a single capture system layer, an additional capture system layer may be formed atop this single layer system, such as by stacking more columns directly atop the existing 16 full column components and/or partial column components. This can involve the same number of columns in a second layer, or more or fewer columns as may be desired for the size of the second layer. The second layer may be supported by the first layer, a raised ground level, and/or other support considerations, as may be appropriate.

Each of load bearing vertical column components 110 can have one or more column openings therein, such that a plurality of elongated horizontal strut components 120 can be used to couple the columns together. Strut components 120 can have distal ends that install into the column openings and/or other locations about the overall system 100, such as various wall components 130. When installed, strut components 120 can transfer physical loads between column components 110 and/or wall components 130, among other system items, such that overall system loads are shared across the system, and physical loads are transferred more uniformly. Taken together, the plurality of load bearing vertical column components and the plurality of elongated horizontal strut components can form an interconnected internal structure for system 100.

A plurality of wall tiles or components 130 can be formed around the exterior side regions of this interconnected internal structure. Wall components 130 can couple to strut components 120, such as at the distal ends thereof, and/or column components 110 or partial column components, such that these wall components collectively form the outer side walls of the overall system 100. These wall components 130 are supported by at least various strut components 120 and/or column components. In various embodiments, support for wall components 130 can also be provided by various floor components 150 and/or the actual underlying ground itself 170. As noted above, wall components 130 can also be seamed together along the edges, and/or seamed along the edges with various ceiling components 140 and/or floor components 150.

A plurality of ceiling tiles or components 140 can be formed and rest atop the top capture system layer of the column components 110, strut components 120, and/or wall components 130. In various embodiments, support for various ceiling components 140 can be provided by columns 110 and/or wall components 130. This plurality of ceiling components 140 collectively defines the outer ceiling of system 100. Also, a plurality of optional floor tiles or components 150 can be formed and rest beneath the bottom of the lowest capture system layer of column components 110, strut components 120, and/or wall components 130. Again, illustrated system 100 has only a single capture system layer, such that ceiling components 140 are formed above this single layer and floor components 150 are formed beneath this single layer. In the event that floor components 150 are not used, then the ground or earth can form the bottom of system 100.

One or more fluid inlets 160 and optional outlets can allow fluid to enter and/or exit the overall system 100. One or more ports 111 can include a maintenance and inspection port, which can be located within one or more ceiling components 140. Such port(s) 111 can be connected to the surface via a pipe or tube, and can be capped at the surface by a cover, if desired. In addition, floor components 150 may have a hole or opening therethrough, so as to facilitate the seepage or filtration of stormwater or other fluid into the soil or ground.

It will be readily appreciated that an overall volume or system volume for system 100 can be defined collectively by the space or volume that is within all of wall components 130, ceiling components 140 and ground components 150 (or optionally, just the ground). Because the internal components (e.g., columns 110 and struts 120) located within this space take up some displacement portion of that overall volume, the actual fluid retention volume of system 100 then is substantially defined by the overall volume minus the displacement volume of the internal components. As can be seen, by having little to no internal walls, ceilings, floors, or the like, this fluid retention volume of modular fluid capture system 100 is maximized when compared with other modular fluid capture systems. In fact, the fluid retention volume of system 100 is substantially greater than the displacement volume of its internal components. In various embodiments, this fluid retention volume can be four times greater, or even ten times greater than the internal component displacement volume.

Figure 1B:
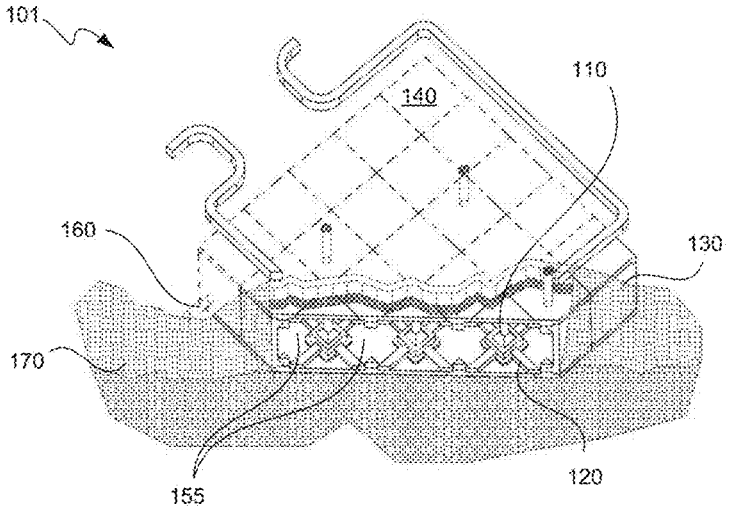
FIG. 1B illustrates in top perspective and partially cutaway view an exemplary alternative modular stormwater capture system having solid floor components installed into an underground region of a development according to one embodiment of the present disclosure.

FIG. 1B illustrates in top perspective and partially cutaway view an exemplary alternative modular stormwater capture system having solid floor components installed into an underground region of a development. As shown, alternative modular fluid capture system 101 can be substantially similar to system 100. In particular, system 101 can be at a similar underground location 170 and can also have the same or similar column components 110, strut components 120, wall components 130, ceiling components 140, and inlet components 160, among other items. Unlike system 100, however, system 101 can have floor components 155 that are solid in nature, such that no ready passage or seepage of water or fluid into the ground beneath the system takes place. Such optional solid floor components 155 in system 101 have no openings therethrough like their counterparts 150 in system 100, such as where design or construction choices might dictate or prefer that all fluid be held and pumped, and/or passed through to another location for processing.

Figure 2A:
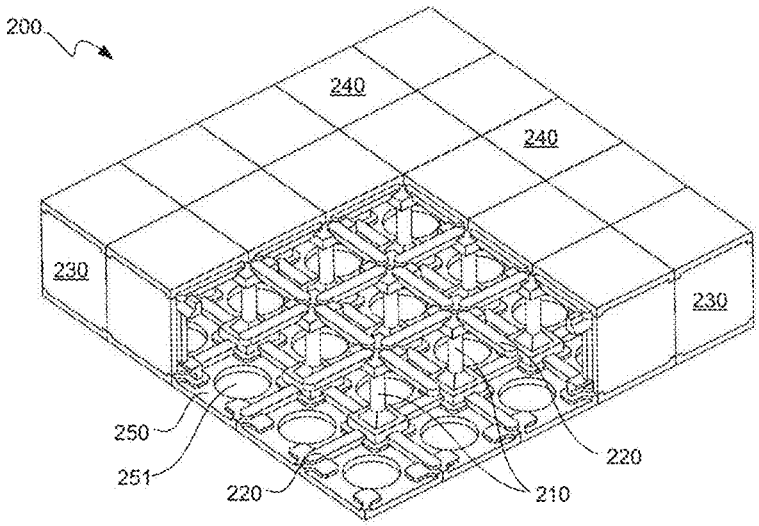
FIG. 2A illustrates in top perspective view a partially assembled exemplary single layer modular stormwater capture system according to one embodiment of the present disclosure.
Figure 2B:
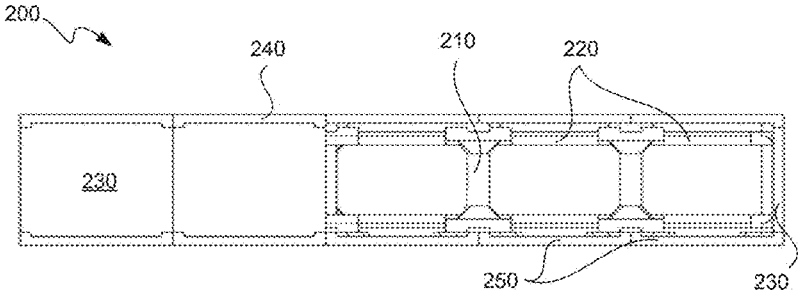
FIG. 2B illustrates in side elevation view the partially assembled exemplary single layer modular stormwater capture system of FIG. 2A according to one embodiment of the present disclosure.

Continuing with FIG. 2A a partially assembled exemplary single layer modular stormwater capture system according to one embodiment of the present disclosure is shown in top perspective view. FIG. 2B illustrates this same partially assembled exemplary system in side elevation view. Single layer modular stormwater capture system 200 can be substantially similar to system 100 above. Again, a single capture system layer is used, and components are arranged into a 5×5 grid formation. Column components 210 are coupled together with strut components 220 to form an internal interconnected structure, upon which wall components 230, ceiling components 240, and ground components 250 are formed. Ground components 250 have openings 251 therethrough, and as such are of the open variety that allow water seepage or passage to the soil or ground directly beneath the system 200.

As shown, system 200 is partially assembled in that it is missing about nine ceiling components 240 and about six wall components 230. Upon the installation of these remaining items, one will then not be readily able to see the column components 210 and strut components 220 that are on the inside of the system 200. As can also be seen, the various wall components 230, ceiling components 240, and ground components 250 can be formed in such a manner that these various components interlock with each other when assembled together. Again, the various system components are assembled in a modular fashion such that any external loads that are incumbent upon any of the wall 230, ceiling 240, and/or ground 250 components are distributed across most, substantially all, or all of the entire system 200, due to the interconnected nature of the columns 210 and strut 220 with the rest of the system components.

Figure 3:
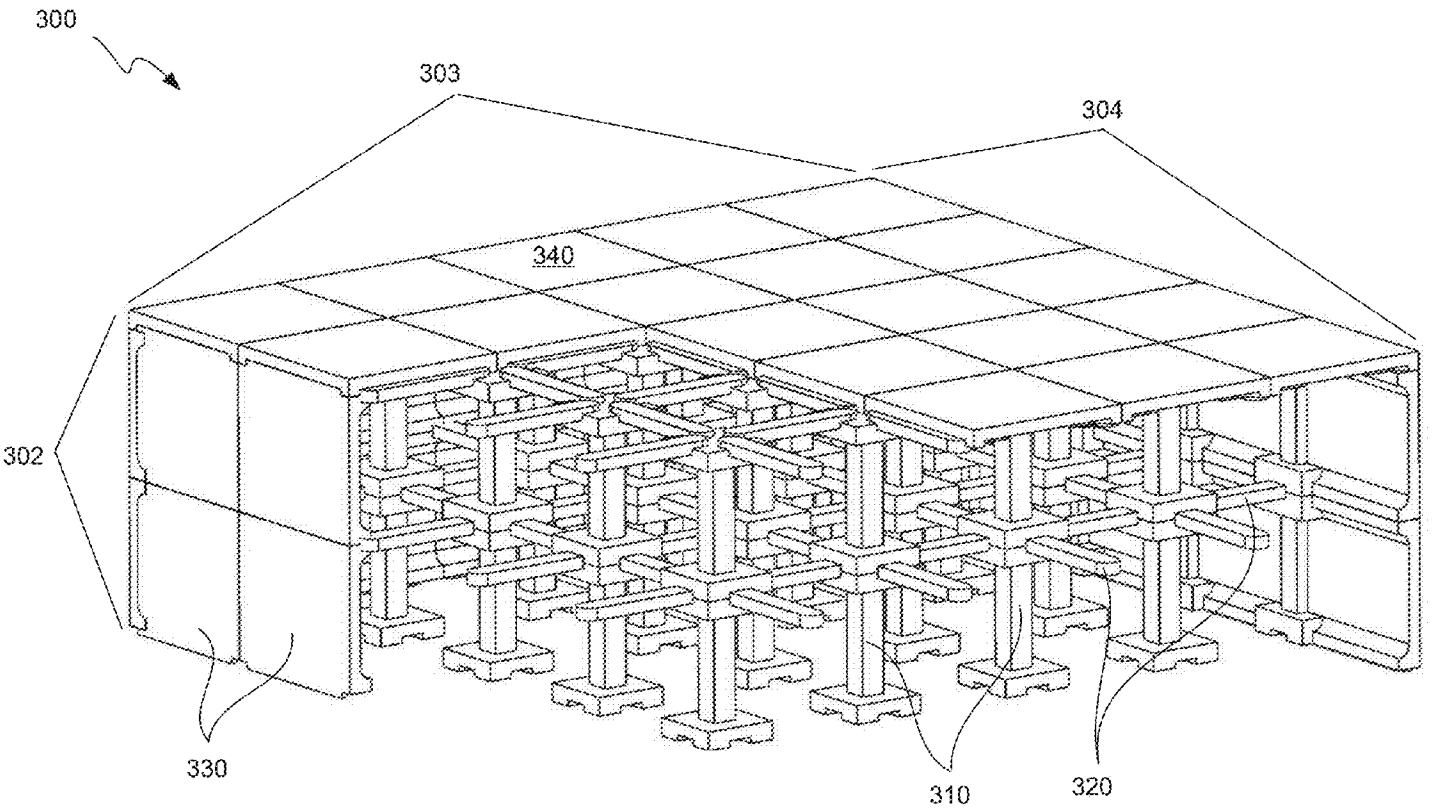
FIG. 3 illustrates in side perspective view a partially assembled exemplary two layer modular stormwater capture system according to one embodiment of the present disclosure.

Turning next to FIG. 3, a partially assembled exemplary two layer modular stormwater capture system is illustrated in side perspective view. Similar to the foregoing embodiments, modular fluid capture system 300 can be formed in a modular fashion from various column components 310, strut components 320, wall components 330, and/or ceiling components 340. Ground components are optional, in lieu of the actual soil or ground, and are not shown here. Unlike the foregoing embodiments, system 300 has two capture system layers, such that column components 310 are all spaced apart in all lateral directions from each other as before to form a first capture layer, but are also stacked atop each other and spaced apart laterally to form a second capture system layer. The number of capture system layers (2) is represented by height parameter 302, while the width (5) and length (5) are represented by width parameter 303 and length parameter 304 to form an overall 2×5×5 capture system 300.

As will be readily appreciated, the foregoing exemplary fluid capture systems 100, 101, 200, and 300 can be readily decreased modularly in size, increased in size, and/or altered in shape in any of the height, width, and length parameters in order to form a specific customized system for a given fluid retention need in an available space of varying sizes and shapes. Where size and space considerations are particularly strenuous or demanding in a given application, various dog-legs, attics, and other irregular shapes and extensions can be formed in a given fluid capture system. This can be accomplished via the modular rearrangement of column components, whereupon the various struts, walls, ceilings and floors can then be assembled thereto to form a finished structure.

For any of the foregoing fluid capture systems, as well as any larger, smaller, and/or customized shape capture system, various general principles of the present disclosure may apply. In particular, the various vertical and horizontal load members (e.g., columns and struts) can be connected via slots, grooves, or other openings in one or both of the types of load members. For example, slots, grooves, or other openings can be formed in the capitals and plinths of the columns, as well as in the walls, ceilings, and/or floors, such that struts, rails, and/or other support members can insert into these various openings to couple all of the components together in a "clam shell" fashion. The system X, Y, and Z axes can thus all be connected positively to distribute loads in a substantially uniform and homogenous manner.

Again, minimum dimensions can be used to keep each individual internal and outer component as lightweight, small, and manageable as possible. For example, it is contemplated that most or all components weigh less than about 200 pounds. In various embodiments, most of all components can be formed from concrete, and can weigh from about 50 to about 200 pounds, such that modular design and assembly without cranes or heavy machinery can be readily accomplished. Where column components or other items are vertically stacked, such relatively smaller structural members can act together as a composite member providing a uniform response.

In general, the overall assembled system provides an internal cavity or volume with no channels and that is unobstructed with respect to fluid passage and retention. Internal displacement volumes are minimized. For example, using the various forms of column components disclosed herein can result in no more than about 0.087 square feet of obstruction or displacement for every 5.44 square feet of system footprint. Other suitable per unit obstruction or displacement values may also be obtained by varying the dimensions and shapes of the various internal components, as will be readily appreciated.

In various embodiments, gaps can be eliminated or minimized between the various wall, ceiling, and floor tiles or components. In instances where some minimal gaps still exist, such gaps can be bridged and/or abutted by the strut components and/or the tops or bottoms of the column components in a manner that hydraulically disconnects a flow path from the inside to the outside of the system. As such, the overall system is readily sealed in a manner that effectively eliminates or reduces fluid leakage from inside the system to the outside, such that additional sealants or components along the exterior of the system are not needed.

Various details regarding exemplary modular system components will now be provided. It will be readily appreciated that such details are only illustrative in nature, and that a wide variety of differences in disclosed features may be implemented, as well as various additional features included, as may be desired for a given modular capture system.

Figure 4A:
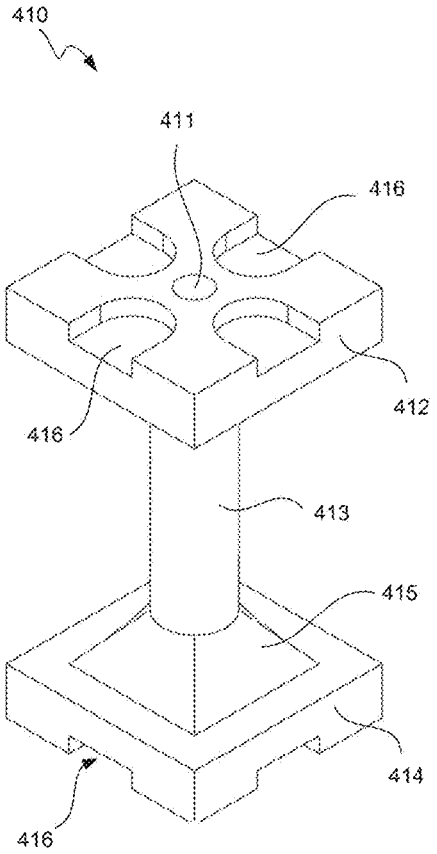
FIGS. 4A-4C illustrate in front perspective, top plan, and side elevation views respectively an exemplary vertical column component according to one embodiment of the present disclosure.
Figure 4B:
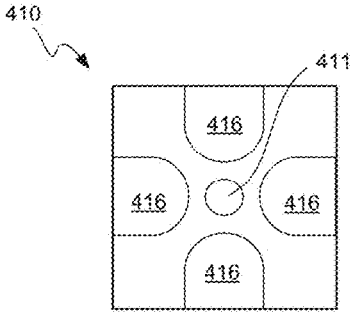
Figure 4C:
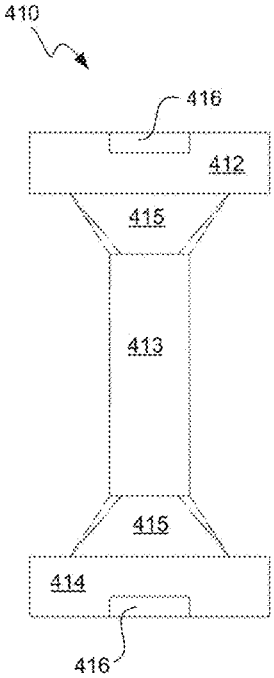
Figure 5A:
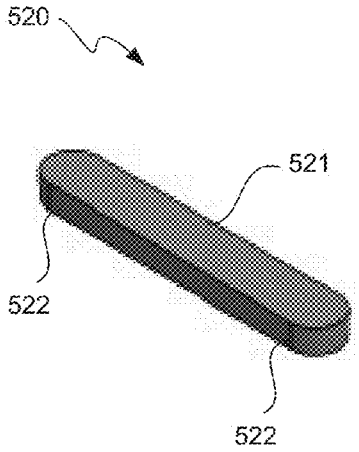
FIGS. 5A-5D illustrate in front perspective, top plan, front elevation, and side elevation views respectively an exemplary horizontal strut component according to one embodiment of the present disclosure.
Figure 5B:
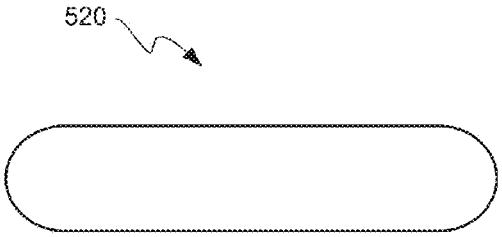
Figure 5C:
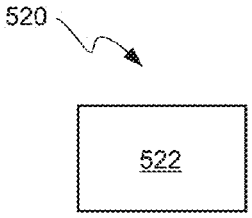
Figure 5D:
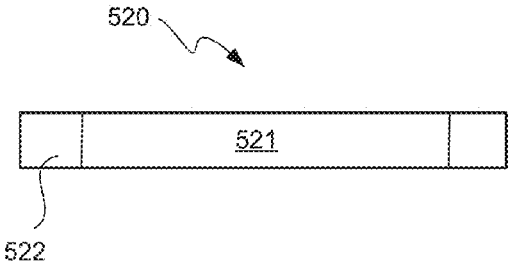

Moving next to FIGS. 4A-4C, an exemplary vertical column component according to one embodiment of the present disclosure is shown in front perspective, top plan, and side elevation views respectively. Load bearing vertical column component 410 represents a "full" column component and can include a capital portion 412, a shaft portion 413, and a plinth portion 414. A central opening 411 within the column component 410 can serve to reduce weight and help facilitate the manufacture of the column component itself, as well as the overall system. Although opening 411 may form a channel that runs through the center of column component 410 through which fluid might travel in some arrangements, this opening 411 can be covered by corners of associated ceiling components when a typical system is fully assembled. As such, opening 411 is typically obstructed to free fluid flow in a fully assembled system. One or more tapered regions 415 can transition the column 410 between the shaft portion 413 and the capital portion 412, as well as between the shaft portion 413 and the plinth portion 414.

A plurality of openings 416 in one or both of the capital portion 412 and the plinth portion 414 can be adapted to hold one or more horizontal struts or other structural components. These openings 416 can be slots, grooves, or any other formation that can readily hold and support struts and/or other structural components. Opening 416 in stacked columns 410 can be aligned such that a given strut, rail, or other structural component can insert into such aligned openings in stacked columns. In various embodiments, column component 410 can be integrally formed from a single material, such as, for example, precast concrete. In other embodiments, column component 410 can be formed from multiple parts, such as separately formed capital portion 412, shaft portion 413, and plinth portion 414. Although a wide variety of specific sizes can be used, it is specifically contemplated that column component 410 can be about two feet tall. In various embodiments, one or more "half" or partial column components can be formed at various wall locations, as set forth in greater detail below.

FIGS. 5A-5D illustrate in front perspective, top plan, front elevation, and side elevation views respectively an exemplary horizontal strut component according to one embodiment of the present disclosure. Elongated horizontal strut component 520 can include an elongated main body section 521 and one or two distal ends 522, which may be rounded or otherwise shaped to facilitate better couplings with other system components. Although typically referred to as a strut, strut component, or horizontal strut component herein, it will be readily appreciated that the terms rail or rail component can also apply for this structural item. Strut components 520 may also be formed from precast concrete, as well as other materials that may be suitable for coupling system components together and distributing loads thereacross in a substantially uniform manner.

FIGS. 6A-6D illustrate in front perspective, top plan, front elevation, and side elevation views respectively an exemplary wall component according to one embodiment of the present disclosure. Wall tile or component 630 can have a main flat section or region 631, as well as one or more protrusions 632 therefrom. Various features 633 can be formed as part of a protrusion 632, and can be used to couple wall component 630 to another wall component, a ceiling component and/or a floor component. One or more other features 634 can be used to provide a coupling region or space for a distal end of a strut component, as set forth above. One or more flat side or edge regions 635 can abut another adjacent wall tile or component.

In general, wall tile or component 630 can have various protrusions 632, features 633, 634, and side or edge regions 635 as may be appropriate given where the given wall tile or component is to be installed with respect to other walls, ceilings, floors, and/or other system components. Variations in the various features 633, 634, and side regions 635 can be formed or implemented as may be suitable given component locations. As such, several different types of wall tiles or components 630 can be formed, such as, for example, top level tiles, bottom level tiles, middle level tiles, single level tiles, and corner tiles for each of these variations, among other possibilities.

FIGS. 7A-7D illustrate in top plan, front elevation, side elevation and bottom plan views respectively an exemplary alternative wall component according to one embodiment of the present disclosure. Alternative wall tile or component 739 can be a top level corner tile that is used at a top level corner of an overall respective capture system, such that several specialty features are present. Similar to wall tile or component 630 above, this wall tile 739 can include a main flat region or portion 731, as well as one or more protrusions 732 and features 733, 734 to facilitate coupling with a ceiling component and/or a strut component. Wall tile or component 739 also includes a flat side region 735 for abutting against another wall tile. Unlike the foregoing example though, wall tile 739 can include an angled side region 736 for abutting against another corner wall tile at an overall corner of the system. A flat bottom region 737 can be located along a bottom edge of wall tile 739, and can be adapted for abutting against the ground or another wall tile having a similar flat region at a top edge thereof.

Figure 6A:
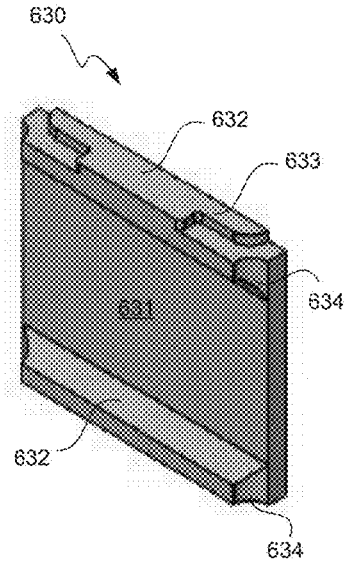
FIGS. 6A-6D illustrate in front perspective, top plan, front elevation, and side elevation views respectively an exemplary wall component according to one embodiment of the present disclosure.
Figure 6B:
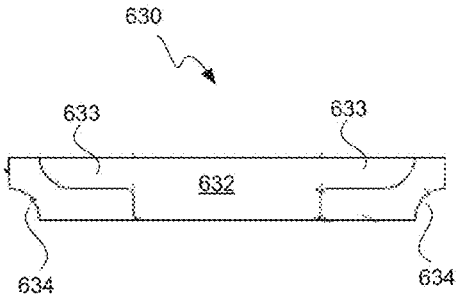
Figure 6C:
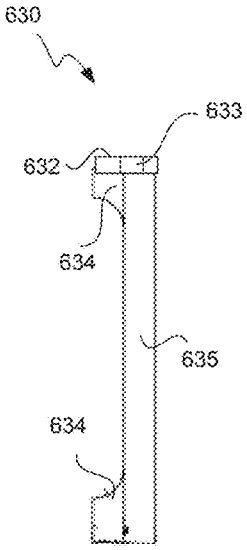
Figure 6D:
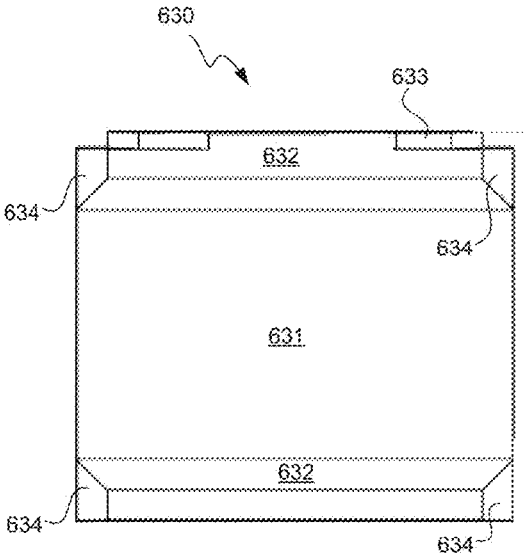
Figure 7A:
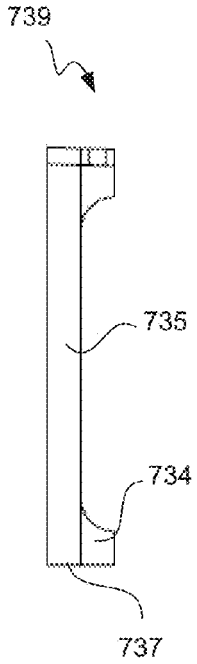
FIGS. 7A-7D illustrate in top plan, front elevation, side elevation and bottom plan views respectively an exemplary alternative wall component according to one embodiment of the present disclosure.
Figure 7B:
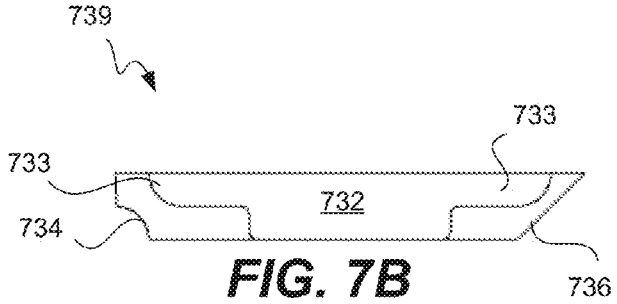
Figure 7C:
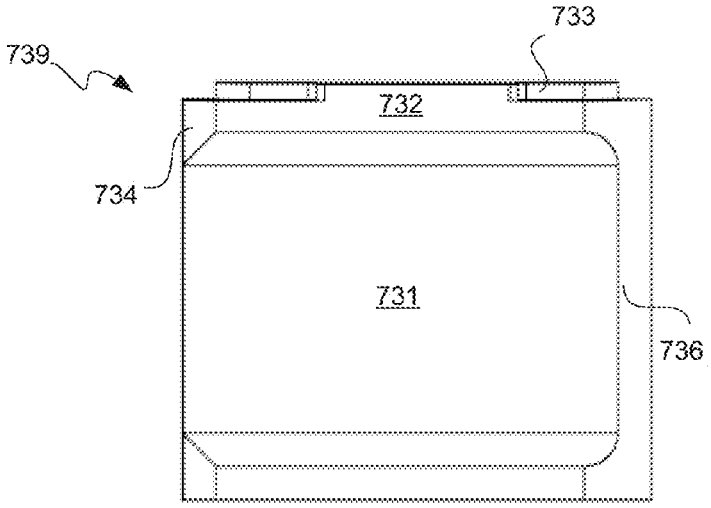
Figure 7D:
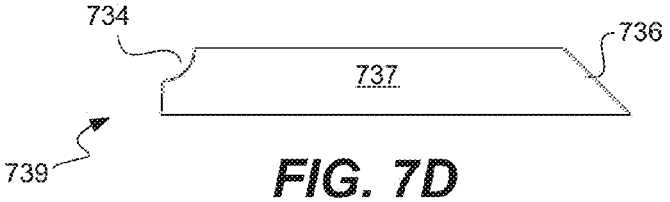
Figure 8A:
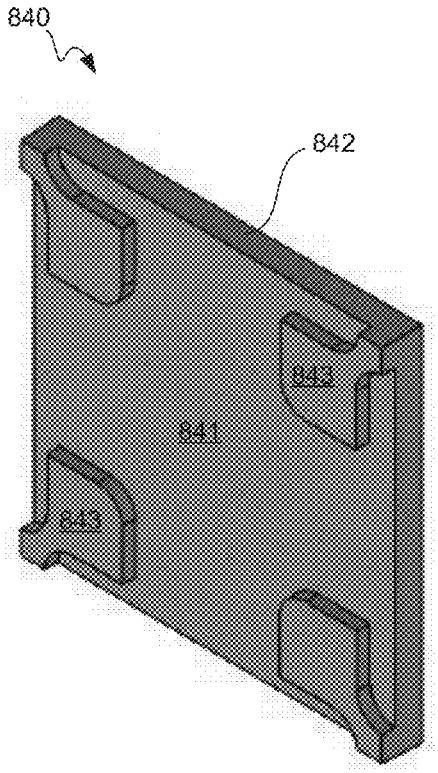
FIGS. 8A-8C illustrate in side perspective, bottom plan, and side elevation views respectively an exemplary ceiling component or solid floor component according to one embodiment of the present disclosure.
Figure 8B:
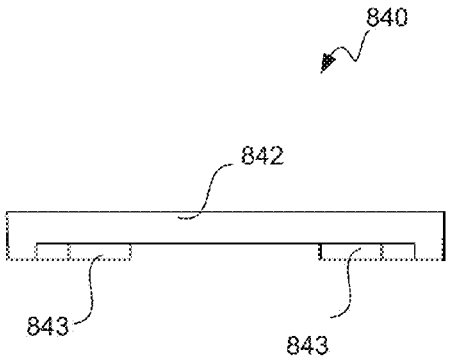
Figure 8C:
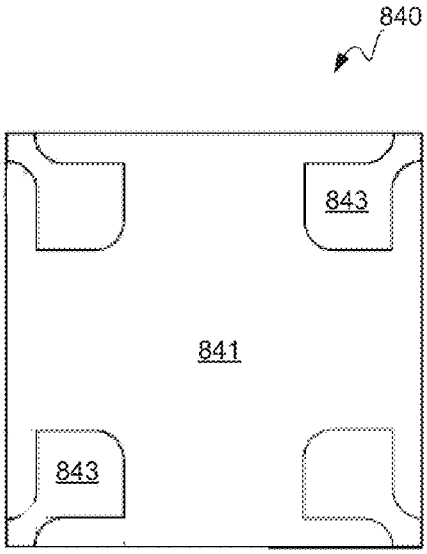

FIGS. 8A-8C illustrate in side perspective, bottom plan, and side elevation views respectively an exemplary ceiling component according to one embodiment of the present disclosure. Ceiling component or tile 840 can include a main flat region or portion 841 and a plurality of flat edge or side regions 842, as well as a plurality of protrusions 843 having various mating features thereon. As can be seen, protrusions 843 are shaped such that ceiling component or tile 840 can mate suitably with either the upper edge features of a wall component or tile, and/or the arrangement of a two column components and a strut coupled therebetween. Reference to FIGS. 2A, 3, and 6A can help to show how the featured protrusions 843 of ceiling component or tile 840 can facilitate a mating of the ceiling tile with various arrangements of wall tiles, columns, and/or struts.

Figure 9A:
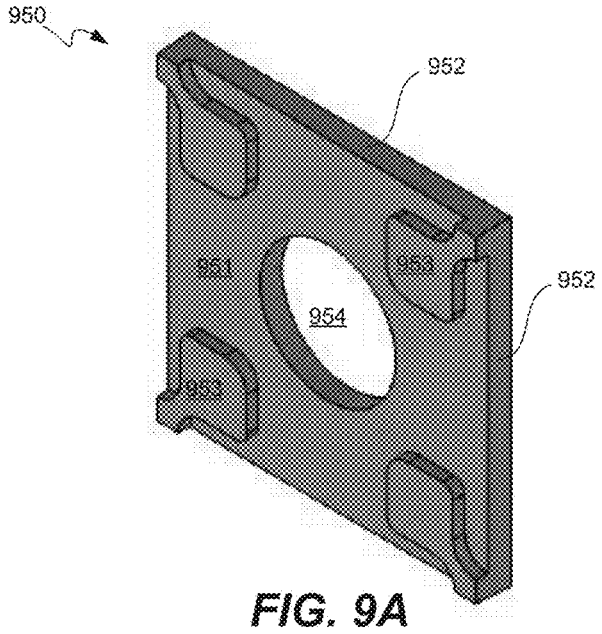
FIGS. 9A-9C illustrate in side perspective, top plan, and side elevation views respectively an exemplary floor component according to one embodiment of the present disclosure.
Figure 9B:
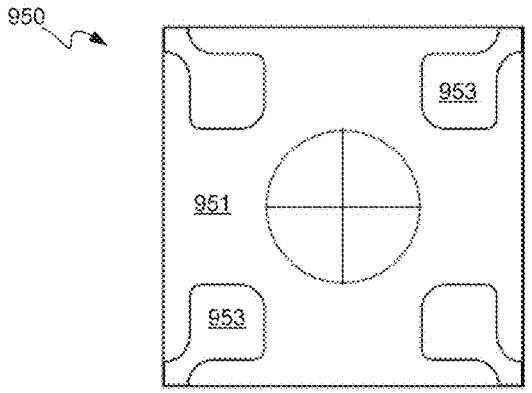
Figure 9C:
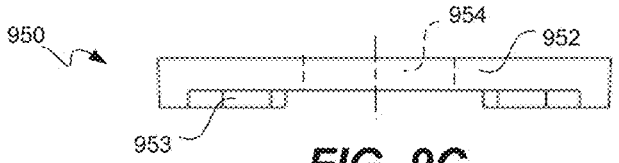

In various embodiments, one or more solid floor tiles, such as floor tile 155 shown in FIG. 1B, can serve as a ceiling tile or a floor tile. That is, ceiling component or tile 840 can also serve as a solid floor tile in some cases. In such arrangements, the various featured protrusions 843 can mate with the bottom portions of columns, struts, and/or wall components or tiles, as may be appropriate.

Where solid floor tiles are not desired however, then FIGS. 9A-9C illustrate in side perspective, top plan, and side elevation views respectively an exemplary floor tile for such variations. Floor tile or component 950 can be substantially similar to ceiling tile 840, in that it can include a main flat region or portion 951 and a plurality of flat edge or side regions 952, as well as a plurality of protrusions 953 having various mating features thereon. In addition, an opening or hole 954 can be formed through the main flat region or portion 951, such that water or fluid can pass therethrough to the soil or ground.

Figure 10A:
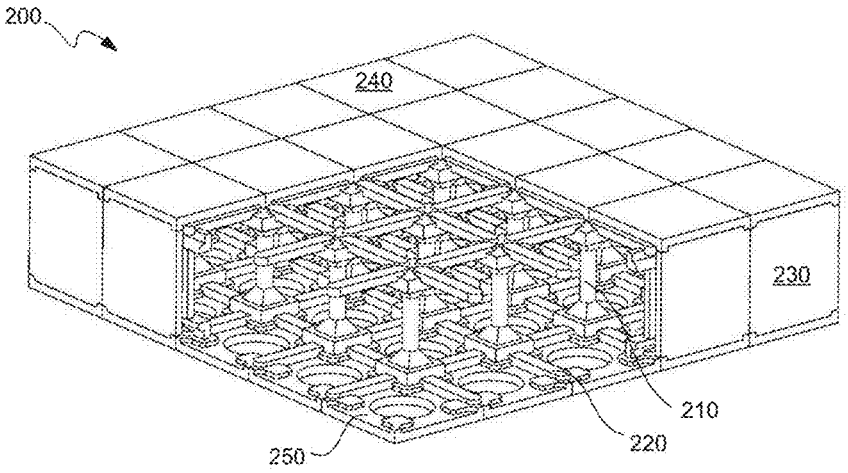
FIG. 10A illustrates in side perspective view the partially assembled exemplary single layer modular stormwater capture system of FIGS. 2A and 2B according to one embodiment of the present disclosure.
Figure 10B:
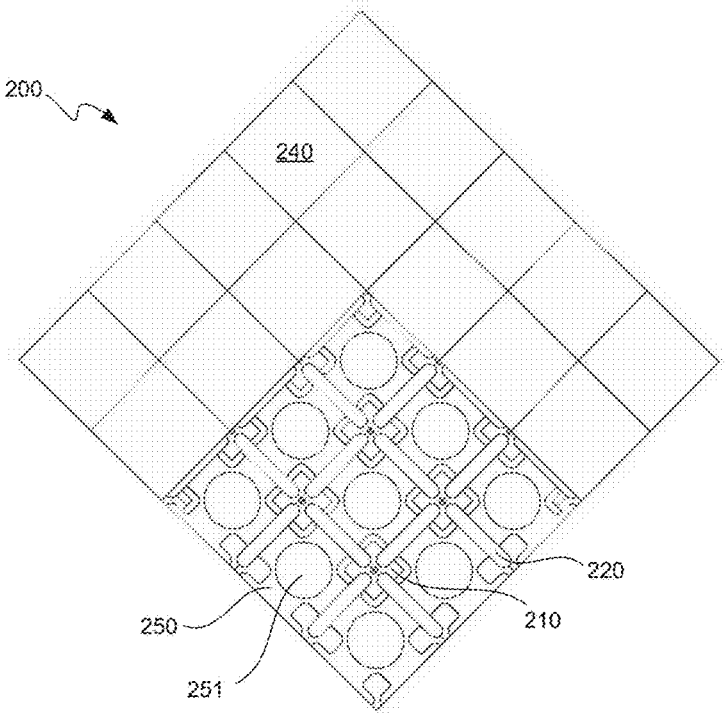
FIG. 10B illustrates in top plan view the partially assembled exemplary single layer modular stormwater capture system of FIGS. 2A and 2B according to one embodiment of the present disclosure.

Although various features and ways of mating the various internal and outer components have been provided, it will be readily appreciated that alternative features and ways of mating component can be used. Various further views and perspectives of such mating features and other system properties can be seen in FIGS. 10A and 10B, which illustrate in side perspective and top plan views respectively the partially assembled exemplary single layer modular stormwater capture system of FIGS. 2A and 2B. Again, capture system 200 can have various columns 210, struts, 220, walls 230, ceilings 240, and floors 250, which floors can have drain openings 251 therethrough.

Figure 11:
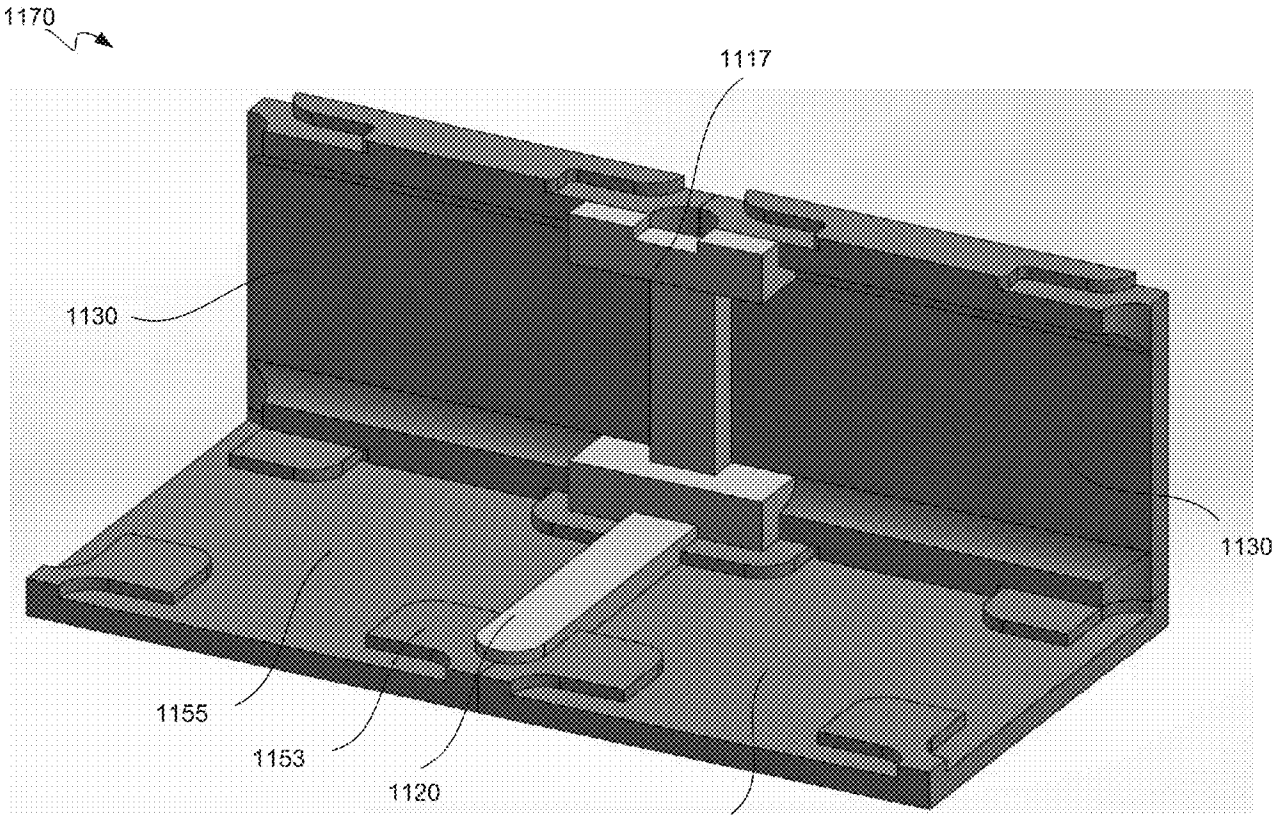
FIG. 11 illustrates in side perspective view a partially assembled wall, strut and column region of an exemplary modular stormwater capture system according to one embodiment of the present disclosure.

FIG. 11 illustrates in side perspective view a partially assembled wall, strut and column region of an exemplary modular stormwater capture system according to one embodiment of the present disclosure. As will be readily appreciated, "full" column components such as those set forth above are not ideally suited for locations at the actual walls of an overall system. Wall region 1170 of an overall capture system depicts the use of a "half" or "partial" column component 1117 rather than a full column component such as those set forth above. Half column component 1117 can take the form of a full column component that has been divided from top to bottom, such that this half column component has half a capital portion, half a shaft portion, and half a plinth portion, as shown. As such, this half column component 1117 is more readily adapted to be placed at and provide support at the intersection of two wall components 1130, two floor components 1155 having various mating features 1153, and one or more horizontal struts 1120. As in the case of half or partial column component 1117, other suitable modifications or adjustments to the various internal and/or outer components can be made where appropriate, such as at other edge or boundary conditions of the system.

Figure 12:
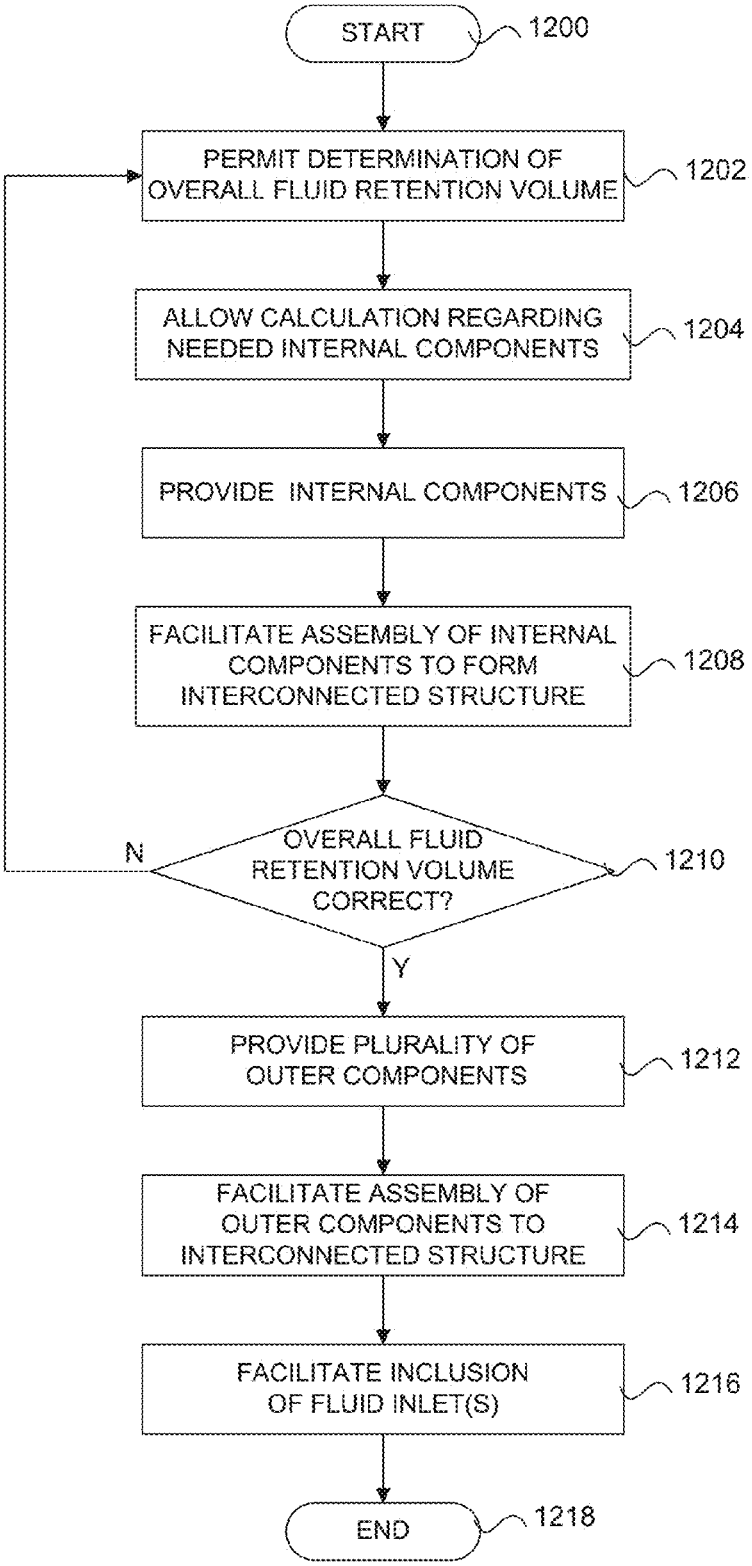
FIG. 12 illustrates a flowchart of an exemplary method of retaining stormwater runoff beneath a ground surface according to one embodiment of the present disclosure.

Moving lastly to FIG. 12, a flowchart of an exemplary method of retaining stormwater runoff beneath a ground surface according to one embodiment of the present disclosure is provided. As in the foregoing embodiments, such a method can involve the use of a modular fluid capture system that is adapted to maximize the overall fluid retention volume of the system, is adapted to distribute external loads substantially uniformly across the system, and can be assembled readily without a need for heavy machinery. After a start step 1200, a determination of the overall fluid retention volume needed for a given system or project can be permitted at process step 1202. A calculation regarding the amount or number(s) of one or more internal components needed for such an overall fluid retention volume can then follow at process step 1204. Again, such internal components can be, for example, columns and struts. These numbers or amounts can correspond to that which would be needed for a given A×B×C size system, which would result from the determination of the overall fluid retention volume that is needed.

A subsequent process step 1206 can involve providing the internal components, after which process step 1208 can involve facilitating assembly of the internal components to form an interconnected internal structure. An inquiry can be made at decision step 1210 as to whether the overall fluid retention volume is correct. This can be done, for example, as a double check, or as a result of one or more variances or adjustments to an overall construction or development project that might result in a change fluid retention volume for a subject water capture system. If the overall fluid retention volume is not correct, then the method reverts to process steps 1202 and 1204, where the overall fluid retention volume can be redetermined and the amount of internal components can be recalculated.

If the volume is correct at decision step 1210 though, then the method continues to process step 1212, where a plurality of outer components can be provided. Again, such outer components can be walls, ceilings, floors, and the like. Assembly of the outer components onto the interconnected internal structure can take place at process step 1214, and it should be noted that this step 1214 can begin before step 1208 is fully completed in some embodiments or situations. At process step 1216, the inclusion of one or more fluid inlets into the system can be facilitated, after which the method ends at end step 1218.

For the foregoing flowchart, it will be readily appreciated that not every method step provided is always necessary, and that further steps not set forth herein may also be included. For example, added steps to involve calculating the number of outer components may be added. Also, steps that provide more detail with respect to the actual design, size, and shape of the overall system may be added. Furthermore, the exact order of steps may be altered as desired, and some steps may be performed simultaneously. For example, step 1110 may be performed before, after, or simultaneously with steps 1206-1208 in various embodiments. As another example, steps 1206 and 1212 can be performed simultaneously in some situations.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A modular fluid capture system adapted to retain storm water runoff beneath a ground surface, the modular fluid capture system comprising:

a plurality of vertical column components located at a plurality of vertical column locations and defining one or more capture system layers, wherein each of said plurality of vertical column components has a surface with one or more recesses formed therein;

a plurality of elongated horizontal strut components each having two distal ends received into two of the recesses to thereby connect pairs of column components whereby the strut components form interconnections between the column components and transfer physical loads between the column components;

a plurality of wall components adapted to couple to one or more distal ends of one or more of said plurality of horizontal strut components, or one or more of said plurality of vertical columns, or both;

a plurality of floor components adapted to interlock with and locate a plurality of components including locating a plurality of the vertical column components; and a plurality of ceiling components coupled to the vertical column components to form an interlocking structure with the vertical column components and the horizontal strut components that horizontally locates a grid-like structure of the vertical column components with respect to the ceiling components, said plurality of wall components, said plurality of floor components, and said plurality of ceiling components collectively define outer walls, a floor and a ceiling of said modular fluid capture system and provide a physical and structural barrier to the external environment.

2. The modular fluid capture system of claim 1, wherein at least a portion of said vertical column components are adapted to stack atop other of said vertical column components for each capture system layer at a given vertical column location.

3. The modular fluid capture system of claim 1, wherein the fluid retention volume of said modular fluid capture system is at least four times greater than the displacement volume of the plurality of vertical column components and the plurality of horizontal strut components.

4. The modular fluid capture system of claim 1, wherein a majority or all of said plurality of vertical column components are formed from concrete.

5. The modular fluid capture system of claim 4, wherein each of said plurality of vertical column components weigh between about 50 to 200 pounds.

6. The modular fluid capture system of claim 1, wherein one or more of said plurality of vertical column components each includes a capital portion, a shaft portion, and a plinth portion.

7. The modular fluid capture system of claim 6, wherein a plurality of the capital portions each includes one or more of the recesses formed thereon and a plurality of the plinth portions each includes one or more of the recesses formed thereon.

8. The modular fluid capture system of claim 1, wherein the floor components individually interlock with a plurality of struts, the columns individually interlock with a plurality of struts which locates the columns.

9. The modular fluid capture system of claim 1, wherein a number of said vertical column components can be readily increased or decreased in order to increase or decrease correspondingly an overall size and the fluid retention volume of said modular fluid capture system.

10. A fluid capture system adapted to retain storm water runoff beneath a ground surface, the modular fluid capture system comprising:

a plurality of outer components adapted to be assembled together to define collectively at least outer walls, a tiled floor, and a ceiling, and collectively define an outer surface of said fluid capture system adapted to retain storm water runoff beneath a ground surface;

a plurality of internal components that interconnect with each other when they are assembled to form an interconnected internal structure contained within the outer surface and provide support collectively for said plurality of outer components and external loads incumbent thereupon, wherein said plurality of internal components interact while assembled in an interconnected manner to distribute the external loads across at least some of said plurality of internal components;

wherein said plurality of internal components includes a plurality of vertical column components that are distributed across an internal volume of said fluid capture system and that are all spaced apart from each other in all lateral directions based upon an interlocking of the vertical column components with other components including at least some of the outer components;

wherein at least some of said external components, including external components that define the tiled floor, at least provide two functions including supporting loads transmitted by the internal components and constraining flow of the storm water; and wherein a number of said internal components can be readily increased or decreased in order to increase or decrease correspondingly an overall size and an overall fluid retention volume of said fluid capture system.

11. The fluid capture system of claim 10, wherein each of the plurality of vertical column components includes one or more recesses formed thereon and said plurality of internal components further includes a plurality of elongated horizontal strut components having distal ends installed into the recesses to form the interconnected internal structure.

12. The fluid capture system of claim 11, wherein the strut components are adapted to transfer physical loads between the vertical column components.

13. The fluid capture system of claim 11, wherein a first portion of the plurality of vertical column components are all laterally spaced apart from each other in a grid-like pattern to form a first capture system layer.

14. The fluid capture system of claim 13, wherein a second portion of the plurality of vertical column components are each stacked atop one of the vertical column components in the first portion to form a second capture system layer atop the first capture system layer.

15. The fluid capture system of claim 10, wherein substantially all of said plurality of outer components and substantially all of said plurality of internal components each have an individual weight of less than about 200 pounds.

16. The fluid capture system of claim 10, wherein the number of said plurality of internal components can be readily increased or decreased in order to increase or decrease correspondingly the overall size and the fluid retention volume of said fluid capture system.

17. A fluid capture system adapted to restrain flow of storm water runoff beneath a ground surface, the modular fluid capture system comprising:

a plurality of outer tiles that collectively define an outer surface and an inner surface for the fluid capture system and provide a physical and structural barrier to an external environment, the plurality of outer tiles including floor tiles, wall tiles, and ceiling tiles, the inner surface defining recesses; and a plurality of internal components that vertically and horizontally connect to the inner surface recesses to transfer loads between opposing ones of the outer tiles and to distribute loads between tiles, the plurality of internal components including vertical columns that vertically support the ceiling tiles, and struts that extend horizontally between the recesses in the floor tiles to locate the struts, the struts providing a lateral transfer of loads between the floor tiles, and wherein the vertical columns have lower ends defining recesses that fit over the struts to locate the vertical columns relative to the floor tiles; and the floor tiles individually arranged to form a floor of the fluid capture system and adapted to constrain flow of storm water and to provide primary vertical support for the vertical columns and the ceiling tiles.

* * * * *